US006374752B1

(12) United States Patent
Walser

(10) Patent No.: US 6,374,752 B1
(45) **Date of Patent: *Apr. 23, 2002**

(54) ERGONOMIC COMPUTER WORKSTATION

(76) Inventor: Glenn E. Walser, 1034 Explorer, Duncanville, TX (US) 75137

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/524,485

(22) Filed: Mar. 13, 2000

(51) Int. Cl.[7] ..... A47F 1/00
(52) U.S. Cl. ..... 108/50.01; 108/94
(58) Field of Search ..... 312/223.3; 108/50.01, 108/94; 298/918, 922, 923

(56) References Cited

U.S. PATENT DOCUMENTS

| | | | | |
|---|---|---|---|---|
| 4,365,561 A | | 12/1982 | Tellier et al. | 108/7 |
| D280,478 S | | 9/1985 | Stephens | D6/477 |
| 4,567,835 A | | 2/1986 | Reese et al. | 108/7 |
| D288,157 S | | 2/1987 | Sandor | D6/474 |
| D293,398 S | | 12/1987 | Kwiecinski | D6/430 |
| 4,779,922 A | * | 10/1988 | Cooper | 248/918 |
| 4,815,392 A | | 3/1989 | Soot | 108/65 |
| 4,848,710 A | | 7/1989 | Newman | 248/129 |
| 4,852,500 A | | 8/1989 | Ryburg et al. | 108/105 |
| 4,884,773 A | | 12/1989 | Becker | 248/639 |
| 5,118,172 A | | 6/1992 | Ugalde | 312/208 |
| 5,174,223 A | * | 12/1992 | Nagy et al. | 108/50.01 |
| D339,257 S | | 9/1993 | Scharer et al. | D6/474 |
| D344,420 S | | 2/1994 | Rodriquez | D6/474 |
| 5,287,815 A | | 2/1994 | Gross | 108/50 |
| D345,064 S | | 3/1994 | Adams, Jr. | D6/474 |
| 5,450,800 A | | 9/1995 | Leonard | 108/7 |
| 5,522,323 A | | 6/1996 | Richard | 108/10 |
| 5,589,849 A | | 12/1996 | Ditzik | 345/126 |
| 5,618,020 A | | 4/1997 | Hegarty et al. | 248/442.2 |
| 5,704,298 A | | 1/1998 | Corpuz, Jr. et al. | 108/50 |
| D393,382 S | | 4/1998 | Rutter et al. | D6/474 |
| 5,918,841 A | * | 7/1999 | Sweere et al. | 248/918 |

OTHER PUBLICATIONS internet printout "Your Back and Neck" Feb. 17, 1999 1 page.

internet printout "About Computer–Related Ergonomics and This Web Site" Feb. 17, 1999 2 pages.

internet printout "Ergonomics and Workstation Design" Feb. 17, 1999 2 pages.

internet printout "Computers and Your Vision" Feb. 17, 1999 1 page.

internet printout "Arms, Wrists and Fingers" Feb. 17, 1999 1 page.

* cited by examiner

*Primary Examiner*—Peter M. Cuomo
*Assistant Examiner*—Jerry A. Anderson
(74) *Attorney, Agent, or Firm*—Thompson & Gustavson, L.L.P.

(57) ABSTRACT

A computer workstation (10) is provided which allows vertical motion of a monitor and keyboard through a power lift (20). Further, the mounted monitor is mounted on a monitor support (22) which allows the monitor to be pivoted about a horizontal axis through an angle of about 30°. The keyboard is mounted on a keyboard support (32) which allows the keyboard to be moved vertically relative to the monitor and the workstation and locked in place by a locking mechanism such as a cam (34). The keyboard can also be pivotally adjusted about a horizontal axis for proper positioning. A mouse pad plate (44) is pivoted from the front of the keyboard support (32) to allow a negative angle for use of the mouse. A reference material plate (54) can be mounted on the workstation for reference materials. The workstation is preferably mounted on swivel casters (14) allowing the workstation to be readily moved from position to position. In another embodiment, the workstation(100) has a gas pressure lift assembly(102). In another embodiment, the workstation(150) has a motor driven lift assembly(152).

13 Claims, 9 Drawing Sheets

ERGONOMIC COMPUTER WORKSTATION

TECHNICAL FIELD

This invention relates to workstation design, particularly for use with a computer.

BACKGROUND OF THE INVENTION

The normal computer layout requires a person to be seated with a computer monitor placed on a desk or credenza and the keyboard placed in an undercounter tray. This locks the person into a rigid, fixed dimension computer arrangement. The only adjustment permissible is laterally. In the case of the monitor, angular adjustment about a horizontal and vertical axis is sometimes possible. The sitting height of the person may be changed by adjustment of the chair. However, the person's line of sight is usually slightly up and about 18" to 24" away from the monitor. People with vision deficiencies requiring bifocal or reading glasses very quickly develop neck muscle strain due to the backward arch of the head required to view the monitor through the near vision part of the bifocal lenses.

Many computer operators today utilize a mouse as well. The hand and arm that uses the mouse is usually required to be at a full extended position with an acute angle between the wrist and hand. This position not only is tiring, but can contribute to problems such as carpal tunnel syndrome.

For the reasons set forth above, a need exists for a computer workstation which improves the working environment for the operator.

SUMMARY OF THE INVENTION

In accordance with one aspect of the present invention, a workstation for a computer is provided. The computer has a monitor and a keyboard. The workstation includes a base and a pedestal mounted on the base for vertical movement relative to the base. A monitor support is secured to the pedestal and mounts the monitor thereon for horizonal pivotal motion. A keyboard support is also secured to the pedestal and mounts the keyboard for horizontal pivotal motion independent of the monitor.

In accordance with another aspect of the present invention, a mouse pad plate is mounted to the keyboard support for horizontal pivotal motion relative thereto. In another aspect, a reference material plate is mounted to the monitor support for pivotal motion relative thereto.

In accordance with other aspects of the present invention, a computer tower support can be mounted on the base to support a computer tower. The axis of horizontal pivotal motion of the keyboard support can be below and behind the keyboard position. The base can be mounted on swivel casters for easy movement around the work area.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION

Figure 1:
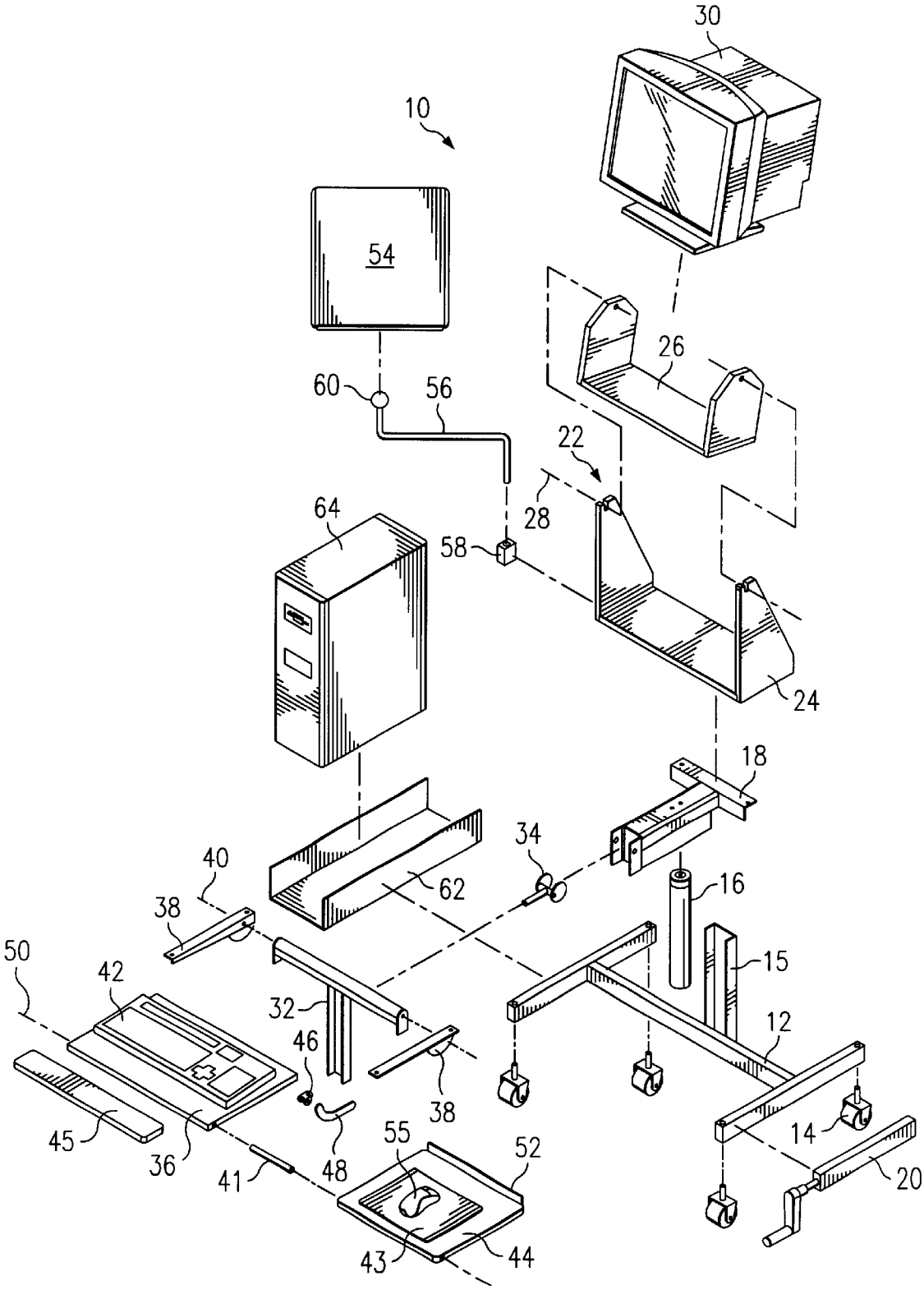
FIG. 1 is an exploded perspective view of a workstation forming a first embodiment of the present invention.
Figure 2:
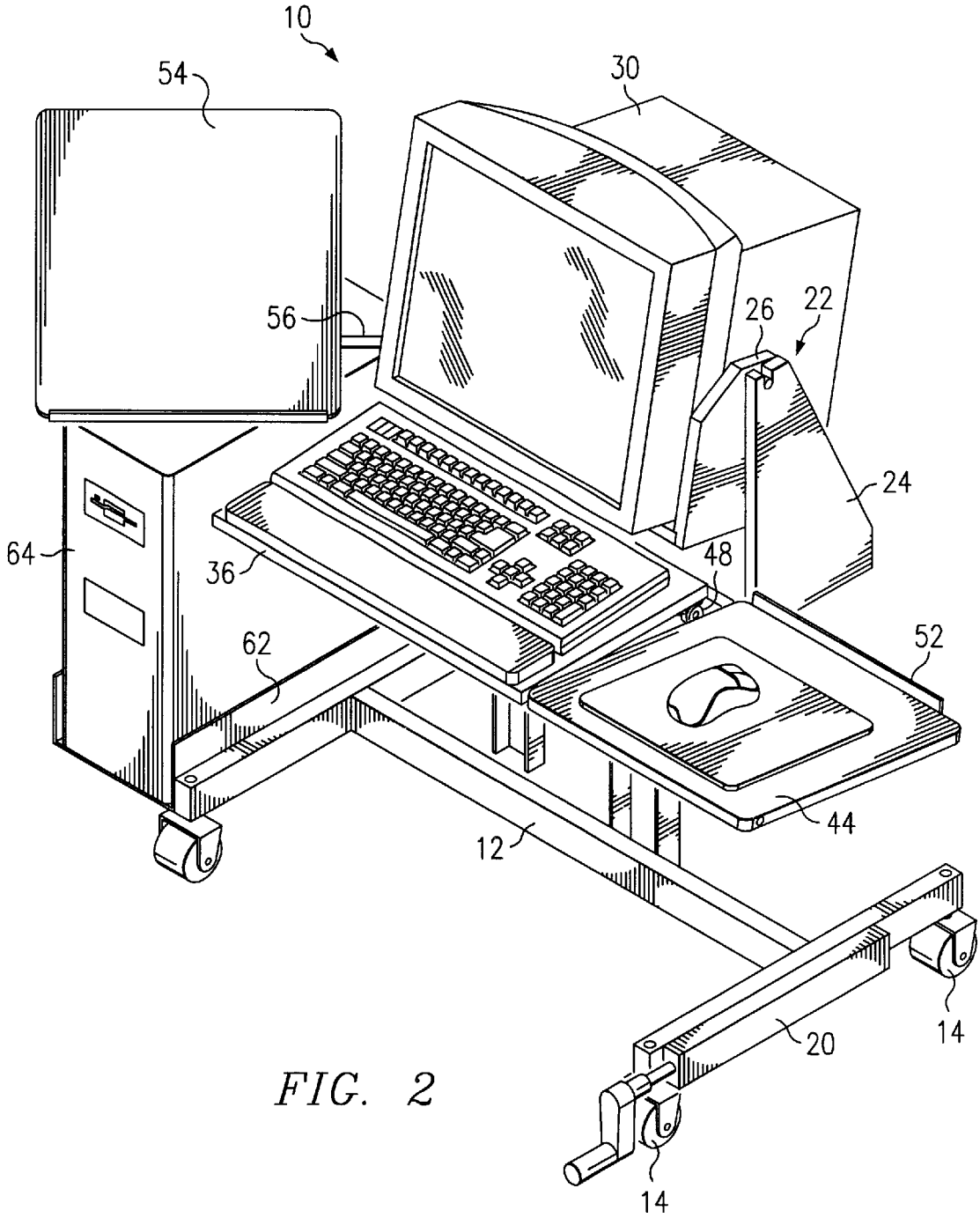
FIG. 2 is a right-hand isometric view of the workstation of FIG. 1.
Figure 3:
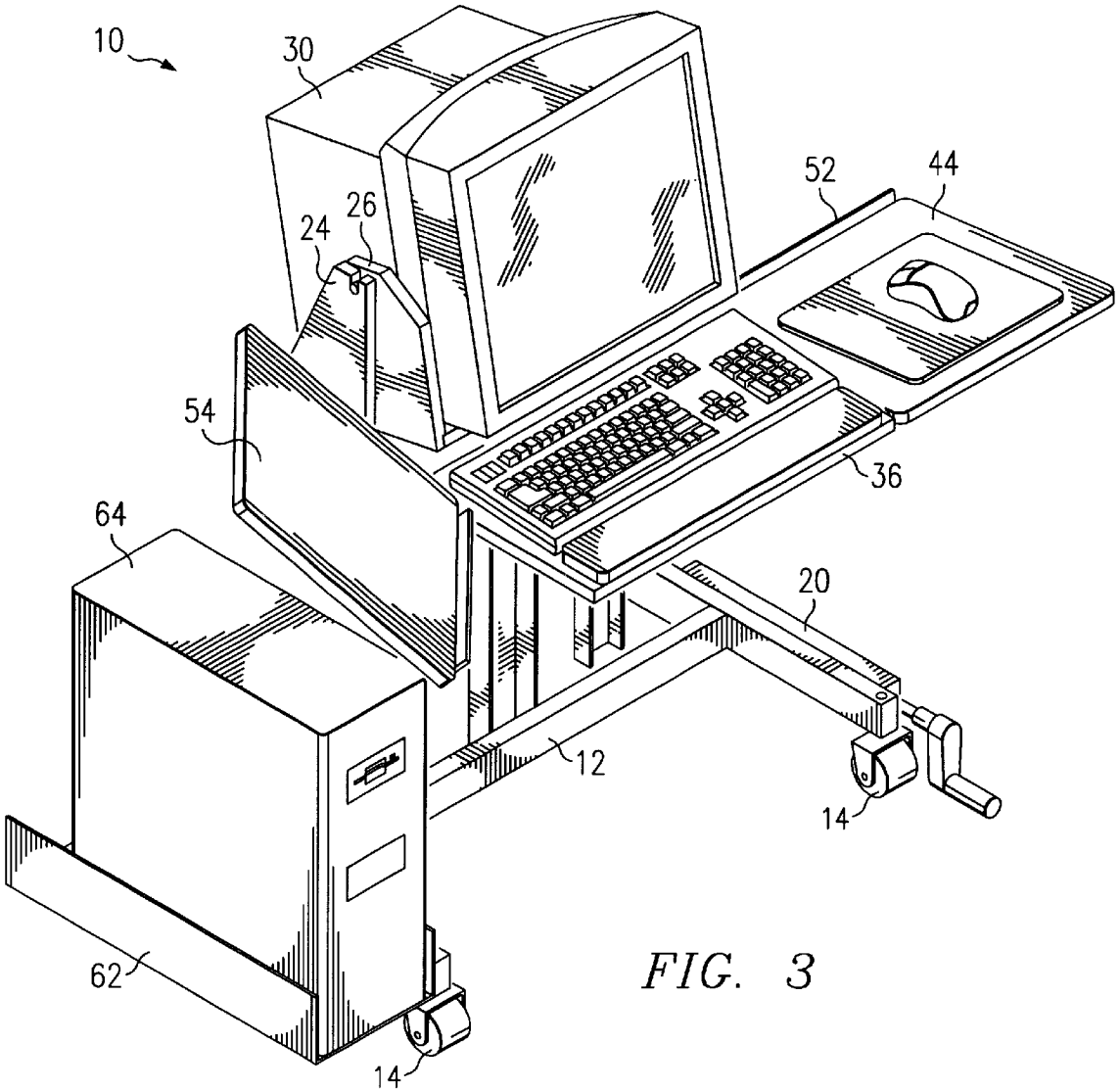
FIG. 3 is a left-hand isometric view of the workstation of FIG. 1.
Figure 4:
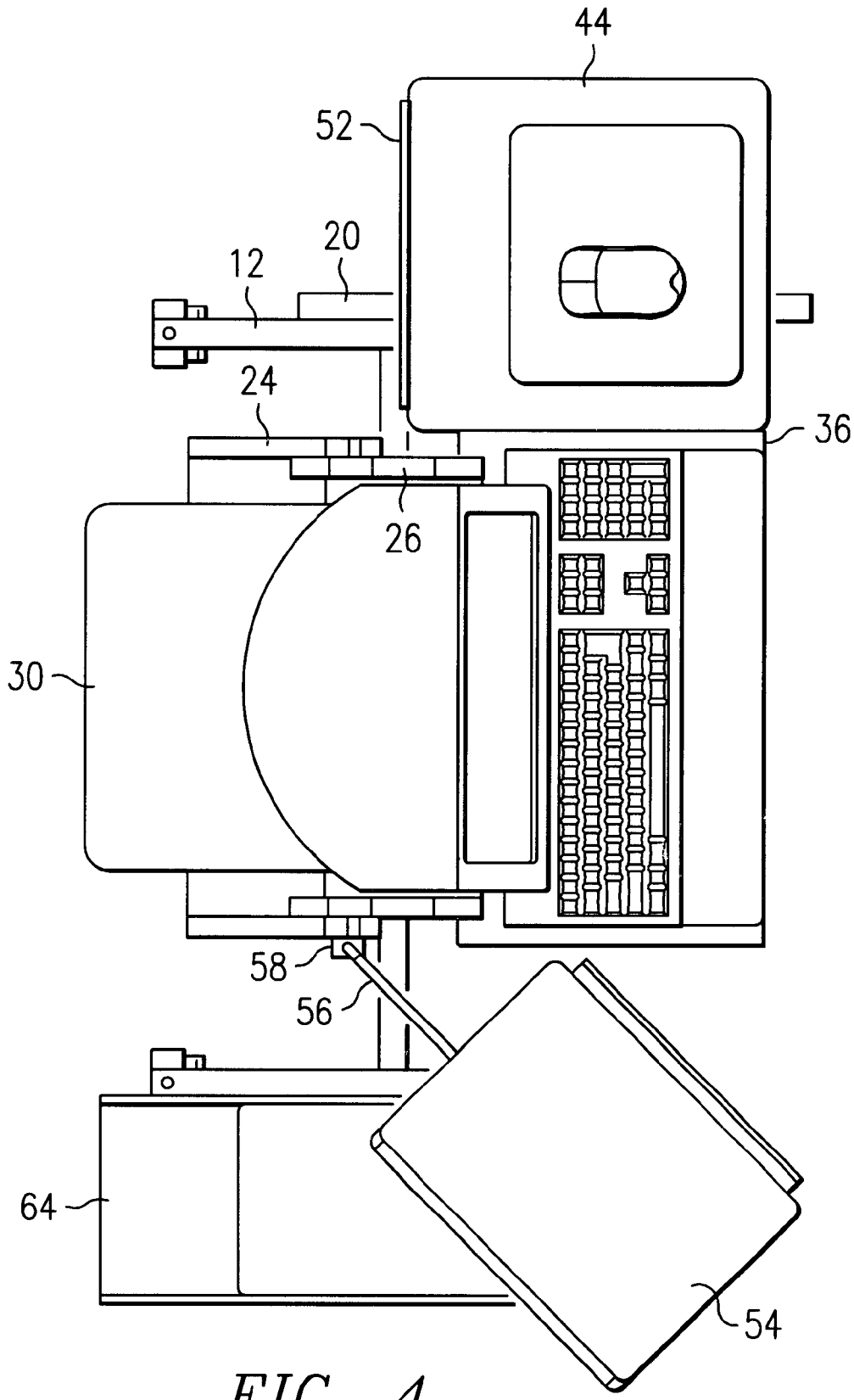
FIG. 4 is a top view of the workstation of FIG. 1.
Figure 5:
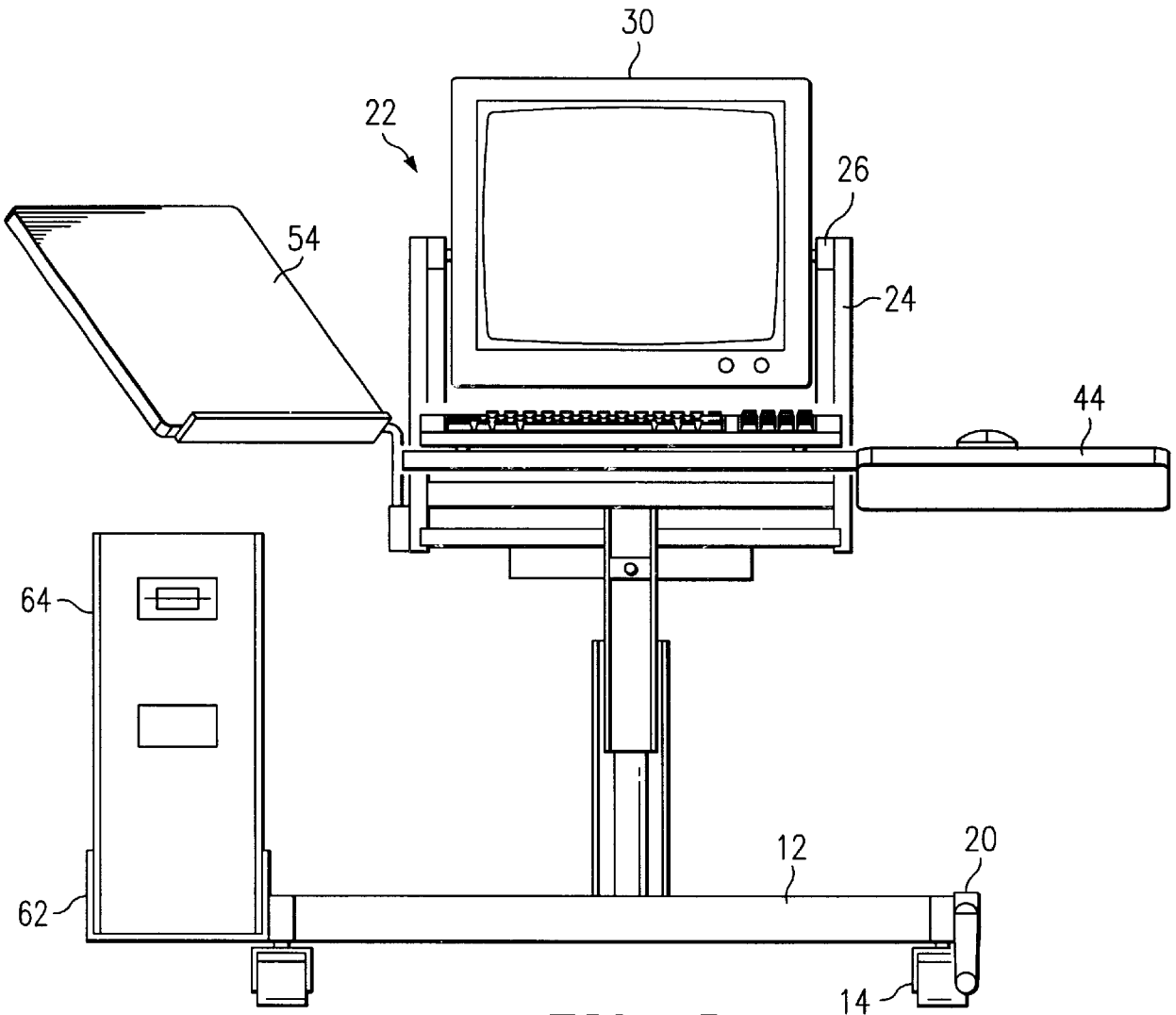
FIG. 5 is a front view of the workstation of FIG. 1.
Figure 6:
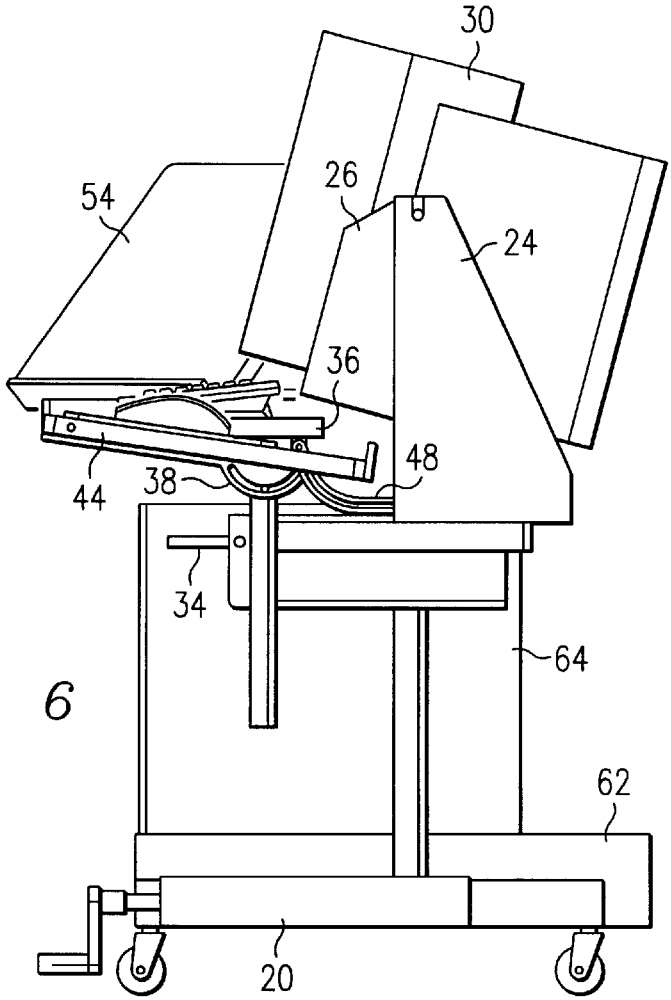
FIG. 6 is a right-hand side view of the workstation of FIG. 1.

With reference now to the accompanying drawings, wherein like or corresponding parts are designated by the same reference numerals, and with specific reference to FIG. 1, a computer workstation 10 forming a first embodiment of the present invention is illustrated. As will be described, computer workstation 10 provides an easily adjustable arrangement to fit the bodily differences and preferences of computer users around the world.

The workstation 10 includes a base assembly 12 which is mounted on four casters 14. This renders the workstation readily portable.

Mounted on the base assembly 12 is a bracket 15 which supports vertical lift cylinder 16. Mounted at the upper end of the lift cylinder 16 is platform assembly 18. The vertical lift cylinder 16 can lift the platform assembly 18 vertically by rotation of the power lift 20 mounted on the base assembly 12. The lift cylinder 16 preferably allows a vertical adjustment of approximately 6" and also permits horizontal rotation of the platform assembly 18 of about 90°.

A monitor support 22 is mounted to the platform assembly 18 near the back of assembly 18 and forms a double yoke cradle including a yoke receiver 24 and a monitor yoke 26. The yoke receiver 24 is rigidly secured to the platform assembly 18. The monitor yoke 26 is pivotally attached to the yoke receiver 24 for rotation about a horizonal axis 28. The monitor 30 is mounted on the monitor yoke 26 for pivotal motion about the horizontal axis 28. Preferably the double yoke cradle formed by monitor support 22 allows approximately a 30° rotation of the monitor about the horizontal axis 28. This can allow the operator to position the monitor in a manner perpendicular to the operator's line of sight, just above the back edge of the keyboard. Adjusting the vertical lift cylinder 16 and pivoting the monitor about axis 28 allows the operator's line of sight to be approximately 15° to 20° below horizontal. This angle permits the user of bifocal glasses or reading glasses to view the monitor through the near vision lens while the head and neck are in a very comfortable relaxed position. The monitor can be positioned 14" to 16" from the operator's eves, thus reducing eye strain and neck strain.

The monitor is preferably mounted on the monitor yoke 26 in a near balance position about axis 28, with Friction mounts between the monitor yoke 26 and yoke receiver 24 to permit the operator to easily change the viewing angle by merely pushing on the monitor in the desired direction of rotation. When released, the monitor will stay in that position because of the friction mounts until again moved by the operator. The height of the monitor can be adjusted using lift cylinder 16.

A keyboard support 32 is mounted near the front end of the platform assembly 18 and can move vertically relative thereto. The keyboard support 32 is locked in a desired vertical position relative the platform assembly 18 by a locking cam 34. A keyboard plate 36 is mounted to the keyboard support 32 by a pair of support angles 38. The support angles 38 permit the keyboard plate 36 to pivot about a horizontal axis 40 below and at the back of the position of the keyboard 42 on the keyboard plate 36.

This design permits the position of keyboard 42 to be adjustable independently of the monitor position, height and angle. Moving the monitor vertically with lift cylinder 16, of course lifts keyboard plate 36 initially as well. However, the keyboard support 32 can be used to readjust the height of keyboard plate 36 as desired. The vertical adjustability of the keyboard support 32 and the pivotal motion of the keyboard plate 36 relative to the keyboard support 32 provides for an optimum positioning. The adjustment of the keyboard plate 36 allows the keyboard to be positioned just about 2" above the operator's lap while in a seated position so that the forearm position is nearly horizontal while typing. A wrist pad 45 can be used on keyboard plate 36.

A mouse pad plate 44 can be mounted to either side of the keyboard plate 36 by a hinge rod 41 and a support track 48 secured to keyboard plate 36 by bracket 46. While the figures illustrate the mouse pad plate mounted on the right side of the keyboard plate 36, convenient for right-handed operators, the mouse pad plate can as readily be mounted on the left side of the keyboard plate 36 for left-handed operators. The mouse pad plate 44 is hinged by rod 41 for movement about a horizontal axis 50 near the front edge of the keyboard plate 36. This allows the mouse pad plate 44 to be rotated to a negative angle from horizontal, i.e., away the operator, so that the wrist and hand can work in an almost straight line, rather than at an acute angle. In this position, the upper arm can work in an almost true vertical plane—the most relaxed position for operator's arms and hands. Because of this position, a bar 52 is mounted at the back of the mouse pad plate 44 so that the mouse 55 will not fall off the plate. The support track 48 preferably has sufficient friction in the engagement with the mouse pad plate 44 to hold the plate 44 in a desired position during normal use of the mouse, but permits adjustment about axis 50 by the application of sufficient force to overcome the friction.

Most operators who use a computer for word processing will require a stand on which to position material that they are transcribing. To provide this feature, a reference material plate 54 is mounted to the monitor support 22 through a support rod 56. One end of the support rod 56 is mounted in a bracket attachment 58 mounted on the yoke receiver 24. The bracket attachment 58 allows the support rod 56 to pivot about a vertical axis. At the other end of the support rod 56 is a ball 60 forming part of a ball and socket joint, with the mating socket on the back of reference material plate 54. This permits the reference material plate 54 to be adjustable about all six degrees of freedom of movement for a convenient and comfortable positioning of reference papers or books. Again, while the reference material plate 54 is shown on the left side of the computer workstation 10, the plate 54 can as readily be mounted on the right side. In fact, a bracket attachment 58 can also be mounted on the right side of the yoke receiver 24 to allow the support rod 56 and reference material plate 54 to be shifted from one side of the workstation to the other.

A computer cradle 62 is mounted on the base assembly 12 to receive the computer tower 64 of the computer. The cradle 62 can be mounted either to the left or right of the operator on the workstation 10 for an easy accessibility to the disk drives. Should the computer tower 64 require maintenance, the entire workstation can be moved for ease of access and the tower cover removed while still in the mounting cradle 62. Cables can run from the computer 64 to the keyboard and monitor as needed.

As can be appreciated, the invention, as embodied by computer workstation 10, provides an easily adjustable computer workstation arrangement to fit the bodily differences and preferences of computer users around the world. The power lift 20 can be utilized to both raise or lower the monitor and keyboard. The monitor can be adjusted independently of the keyboard and the keyboard can be adjusted independently of the monitor. The adjustment in either case is very simple. To adjust the keyboard, the locking cam 34 need only be manipulated to release keyboard support 32, allowing the keyboard support 32 and keyboard to move vertically and, when the desired height is reached, the locking cam 34 is again manipulated to lock keyboard support 32 to platform assembly 18. Pivoting of the keyboard itself is accomplished by simply pivoting the keyboard plate 36 about the support angles 38. Pivoting of the monitors is readily accomplished by pivoting the monitor and monitor yoke 26 about the horizontal axis 28. Only one power connector and any network or modem connections are necessary to be disconnected for movement of the workstation 10 and the computer thereon from station to station or room to room. The workstation 10 mounts the components of the computer on a single frame and provides a very efficient space saving arrangement. The computer workstation will help solve most of the ergonomic considerations people encounter while working on computers. It will also allow each operator the freedom to quickly adjust all the workstation components to their individual personal preferences at their desire. This is a most convenient, comfortable solution for a computer workstation arrangement.

Figure 7:
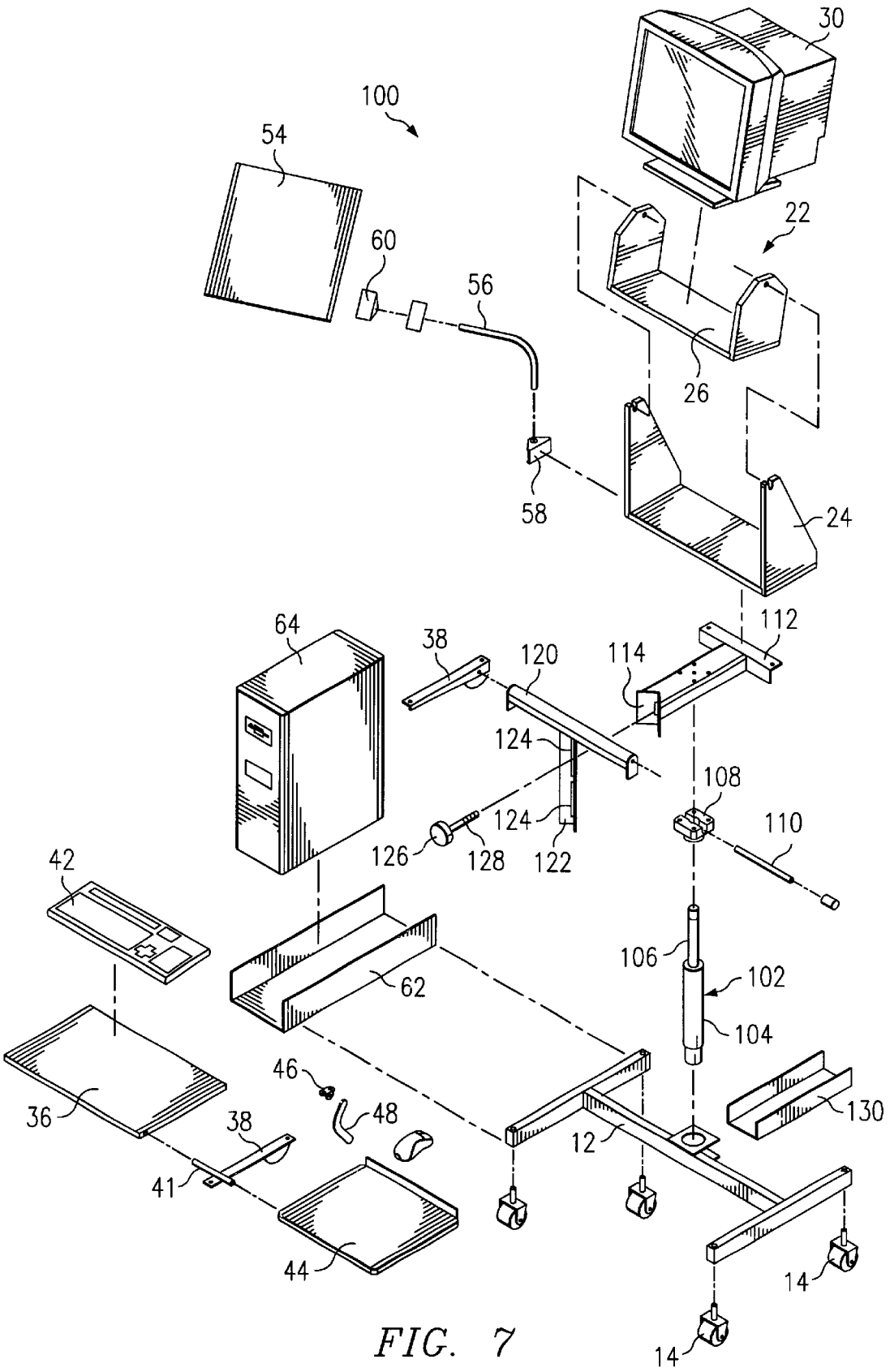
FIG. 7 is an exploded perspective view of a second embodiment of the present invention.

With reference now to FIG. 7, a second embodiment of the present invention will be described and is identified as workstation 100. Most of the elements of workstation 100 are identical to those in workstation 10, and are identified by the same reference numerals. However, the power lift 20 in workstation 10 has been replaced by a gas pressure lift assembly 102, which has a cylinder 104 and piston 106. The gas pressure lift assembly 102 has high pressure gas sealed therein to provide a force on the piston 106 to counteract the weight of the portion of the workstation supported by the piston 106. The platform assembly 112, mounted on the piston 106, can be moved vertically, along with the elements supported on the platform assembly 112 to achieve the desired height. The design of the gas pressure lift assembly 102 is such as to hold the platform assembly 112 in the selected position through normal use. At the top of the piston 106 is mounted a base 108 which contains valving. A handle 110 extends from the base 108 for use by an operator to vary the height of the piston 106 and platform assembly 112. When the height is to be changed, the lever is depressed, activating a valve mechanism within the base 108, permitting the platform assembly 112, and components supported thereby, to be moved vertically. When the desired final position is achieved, the handle 110 is released, closing the valve mechanism in base 108, causing the piston 106 to be fixed relative to the cylinder 104. Gas pressure lift assemblies of the type used for business chairs are suitable for this application. One gas pressure lift assembly found adequate for the workstation 100 is the model C19-62014 gas cylinder manufactured by Suspa, Inc. of 3970 Roger B. Chaffee Blvd., Grand Rapids, Mich. 49508-3497 which provides 8 inches of vertical lift. This design eliminates the need for the power lift 20.

Figure 8:
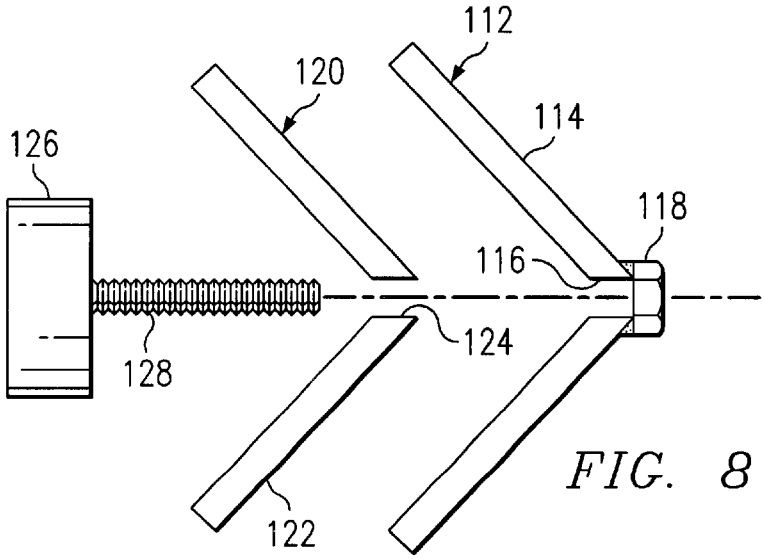
FIG. 8 illustrates details of the embodiment of FIG. 7.

With reference to FIGS. 7 and 8, the platform assembly 112 can be seen to have a forward end defined as an angle 114. An aperture 116 is provided in the angle and a threaded nut 118 is welded or otherwise secured to the angle over the aperture 116. The keyboard support 120 is also formed with an angle 122 to cooperate with the angle 114 of the platform assembly 112. In addition, the angle 122 has one or more vertical slots 124 formed therein. A knob 126 with a threaded shaft 128 is utilized to secure the keyboard support 120 to the platform assembly 112 with the threaded shaft 128 of the knob 126 passing through the slot 124 and threaded into the threaded nut 118 secured to the platform assembly 112. The knob 126, or a spacer between knob 126 and angle 122, comes into contact with angle 122 as the knob is tightened, squeezing angle 122 between the knob 126 and angle 114. Thus, the keyboard support 120 is secured relative to the platform assembly 112 by simply tightening the knob 126, forcing the angle 122 of the keyboard support 120 against the angle 114 of the platform assembly 112 to resist movement. When adjustment is needed, the knob 126 can simply be loosened, permitting the keyboard support 120 to move vertically relative the platform assembly 112 with the threaded shaft 128 of the knob 126 sliding in the slot 124 until the desired vertical position is achieved. The knob 126 is then again tightened to secure the keyboard support 120 in place relative the platform assembly 112. Two slots 124 can be provided, for example. Each slot 124 can be 4 inches long, for example. This would provide about 9 inches of vertical height change if there was a 1 inch separation between the end of one slot 124 and the beginning of the other slot 124.

A receiver 130 is mounted on the base 12 to receive a power protection monitor, or other computer related device. While the computer cradle 62 is illustrated as a U-shaped bracket, it can, alternatively, be a wire frame.

Figure 9:
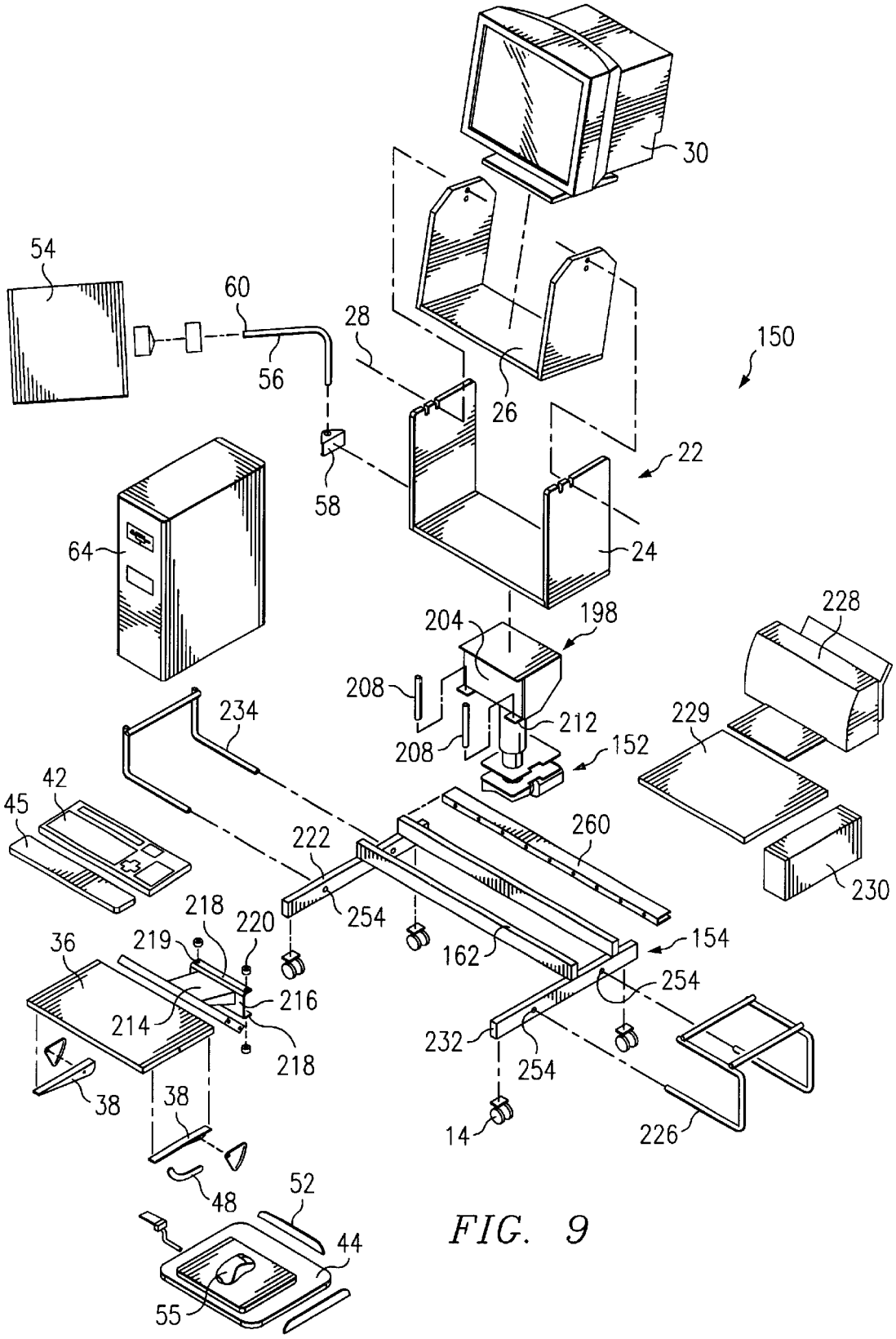
FIG. 9 is an exploded perspective view of a third embodiment of the present invention.
Figure 10:
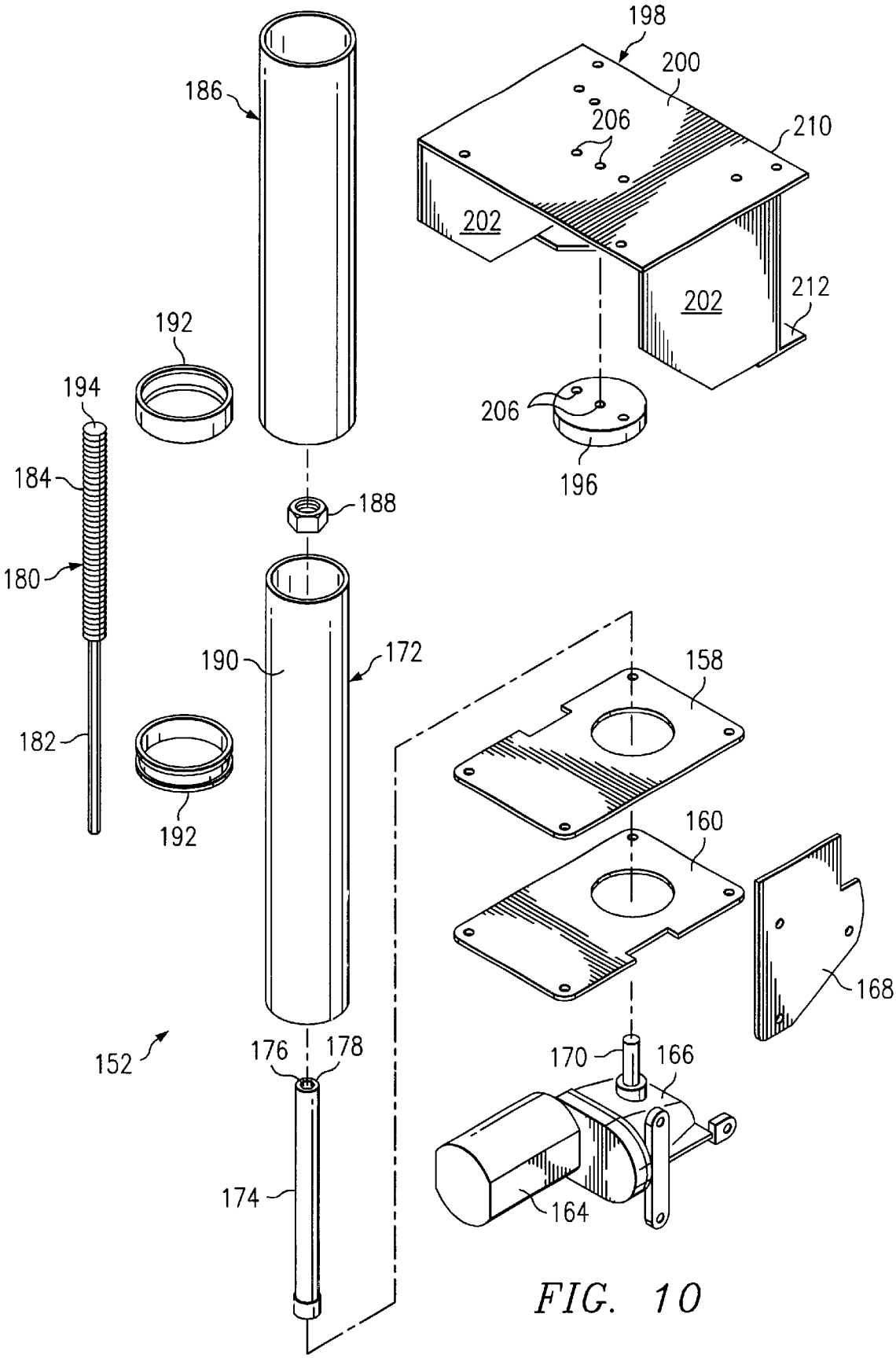
FIG. 10 is an exploded view of the lift assembly of the third embodiment.

With reference now to FIGS. 9 and 10, a third embodiment of the present invention will be described and is identified as workstation 150. Many of the elements of work station 150 are identical to those in workstations 10 and 100 and these elements are identified by the same reference numerals.

However, workstation 150 includes a powered lift assembly 152 which is mounted on base 154 and supports a platform assembly 198. As can best be seen in FIG. 10, the lift assembly 152 includes upper base plate 158 and lower base plate 160 which are positioned on the upper surface 162 and lower surface(not shown) of the base 154, respectively, and secured together by bolts or other suitable fasteners to clamp the plates 158 and 160 to the base 154. An electric motor 164 and gear reduction unit 166 are mounted to the plates 158 and 160 and to a motor mounting plate 168 also secured to plates 158 and 160. The electric motor 164 is reversible and rotates a motor shaft 170 through the gear reduction unit 166. Of course, the gear reduction unit 166 can be eliminated, if desired, and the motor shaft 170 directly driven by the electric motor 164. Alternatively, the electric motor 164 can be replaced by an air operated motor or actuator, a hand operated motor or actuator, or any other suitable device.

A stationary vertical cylinder 172 is mounted on top of the base plates 158 and 160 and is generally concentric with the motor shaft 170. A shaft extension 174 is mounted on the motor shaft 170 and extends upwardly within the stationary vertical cylinder 172. The shaft extension 174 has a passage 176 formed thorough at least the upper portion thereof of hexagonal cross section which opens through the upper end 178 of the shaft extension 174. A lifting rod 180 is provided which has a lower portion 182 of hexagonal cross section and an upper threaded portion 184. At least a portion of the lower portion 182 is received in the passage 176, which insures the lifting rod 180 will rotate with the shaft extension 174 when the motor shaft 170 rotates, but allows the lifting rod 180 to move vertically with respect to the shaft extension and base 154.

A lifting cylinder 186 is mounted concentric with the stationary vertical cylinder 172. A threaded nut 188 is fixedly mounted near the upper end 190 of the stationary vertical cylinder 172 and threaded onto the threaded upper portion 184 of the lifting rod 180. Bearings 192 are set between the stationary vertical cylinder 172 and the lifting cylinder 186 to allow the lifting cylinder 186 to slide vertically relative the stationary vertical cylinder 172. The upper end 194 of lifting rod 180 either bears against or is mounted for rotation relative thereto to a plate 196 secured at the top of the lifting cylinder 186.

As can be understood, when the motor shaft 170 is rotated in a first direction, the shaft extension 174 and lifting rod 180 are rotated in the same direction. However, because the nut 188 to which the lifting rod 180 is threaded is fixed, the lifting rod 180 will be lifted vertically upward, pushing the lifting cylinder 186 upward also due to contact between the lifting rod 180 and plate 196. When the motor shaft 170 is rotated in the opposite direction, the lifting rod 180 is lowered vertically, causing the lifting cylinder 186 to be lowered also. Preferably, the threaded upper portion 184 and lower portion 182 are each long enough to provide for a lift of 6 inches or more.

Platform assembly 198 is mounted to plate 196 at the upper end of the lifting cylinder. The platform assembly 198, as platform assemblies 18 and 112, supports the monitor support 22, keyboard plate 36, mouse pad plate 44, and other components. As the motor shaft 170 is rotated in either direction, the lifting cylinder 186, platform assembly 198 and components mounted thereon are lowered or lifted, depending upon the direction of motion of the motor shaft 170. Preferably a switch(not shown) is mounted within reach of the person using the workstation 150, such as on yoke receiver 24, to allow the operator to operate the electric motor 164 to rotate the motor shaft 170 in either direction to lift or lower the platform assembly as desired. As the lifting cylinder 186 is supported by bearings 192 and lifting rod 180, the lifting cylinder 186, and the platform assembly 198 and components thereon, can be pivoted about the vertical axis, as desired, to position the monitor 30 and keyboard 42 relative the base 154.

The platform assembly 198 can be seen to be formed of a top plate 200, side plates 202 and a front plate 204. The plate 196 is secured to the top plate 200 by bolts received through matching holes 206 formed in the top plate 200 and plate 196. Two vertical guide rods 208 are secured between the front edge 210 of the top plate 200 and two extensions 212 formed on the front plate 204.

A keyboard support 214 is mounted to the platform assembly 198 at the guide rods 208 and slidable vertically along the guide rods 208 to allow adjustment of the keyboard plate 36 and other components mounted on the keyboard support 214 vertically relative the platform assembly 198. As can be seen, the keyboard support 214 includes a vertical plate 216 having a height less than the length of rods 208 to allow vertical motion and horizontally extending portions 218 extending from the top and bottom edge thereof. The horizontally extending portion 218 have aligned apertures 219 to receive the guide rods 208, with bearings 220 in each aperture to guide the keyboard support 214 on the guide rods 208.

A number of mechanisms can be used to secure the keyboard plate 36 in the desired position relative the platform assembly 198. For example, a threaded rod can be threaded through the vertical plate 216 with one end facing the front plate 204 of the platform assembly 198. The opposite end, on the side of vertical plate 216 away from the platform assembly 198, can mount a knob. The end facing the front plate 204 can mount a friction pad. To secure the keyboard plate 36 to the platform assembly 198, it is only necessary to rotate the threaded rod with the knob until the friction pad tightly engages the front plate 204, securing the keyboard plate 36 in a fixed relation to platform assembly 198.

As with workstations 10 and 100, the mouse pad plate 44 can be mounted on either side of the keyboard plate 36 desired, or mouse pad plates 44 can be mounted on both sides of the keyboard plate 36 simultaneously, if desired.

A first leg 232 of the base 154 has holes 254 to receive a wire bracket 226, as shown, to mount a printer 228 and a plate 229 to support the printer 228 on the wire bracket 226 and backup power supply 230, for example. Similarly, the second leg 222 of the base 154 has holes 254 to receive a wire bracket 234 to mount computer tower 64, for example. Preferably, the holes 254 are equally spaced on the legs to allow the operator to mount the brackets 226 and 234 on which ever side of the base 154 is desired. Alternatively, two brackets 226 can be mounted on the base 154 or two brackets 234 can be mounted on the base, if desired. Preferably, a wire tray 260 is mounted on the back of the base 154 through which computer and power cables can be routed to restrain the cables and provide a neater appearance to the workstation 150.

While several embodiments of the present invention have been illustrated in the accompanying drawings and described in the foregoing detailed description, it will be understood that the invention is not limited to the embodiments disclosed, but is capable of numerous rearrangements, modifications and substitutions of parts and elements without departing from the spirit and scope of the invention.

What is claimed is:

1. A workstation for a computer having a monitor and a keyboard, comprising:

a base;

a pedestal mounted on said base for a vertical movement relative the base;

a monitor support secured to the pedestal and mounting the monitor for horizontal pivotal motion;

a keyboard support secured to the pedestal and mounting the keyboard for horizontal pivotal motion independent of the monitor; and a mouse pad plate mounted to the keyboard support for horizontal pivotal motion.

2. A workstation for a computer having a monitor and a keyboard, comprising:

a base;

a pedestal mounted on said base for a vertical movement relative the base;

a monitor support secured to the pedestal and mounting the monitor for horizontal pivotal motion;

a keyboard support secured to the pedestal and mounting the keyboard for horizontal pivotal motion independent of the monitor; and the keyboard support being moveable vertically relative to the pedestal and further includes a locking mechanism to lock the keyboard support in a predetermined position relative to the pedestal.

3. A workstation for a computer having a monitor and a keyboard, comprising:

a base;

a pedestal mounted on said base for a vertical movement relative the base;

a monitor support secured to the pedestal and mounting the monitor for horizontal pivotal motion;

a keyboard support secured to the pedestal and mounting the keyboard for horizontal pivotal motion independent of the monitor; and a reference material plate mounted to the monitor support.

4. The workstation of claim 3 wherein the reference material plate is mounted to the monitor support for six-way motion.

5. A method for adjusting a workstation mounting a computer monitor and a computer keyboard, comprising the steps of:

vertically raising a platform assembly mounted on a base, the platform assembly mounting a monitor support to support the monitor and a keyboard support to mount the keyboard;

pivoting the monitor about a horizontal axis with the monitor supported on a monitor yoke mounted to a yoke receiver for pivotal motion about said horizontal axis;

pivoting a keyboard support plate about a horizontal axis, the keyboard support plate supporting the keyboard thereon, the keyboard support plate pivotally mounted to a keyboard support secured to the platform assembly; and vertically raising the keyboard support relative to the platform assembly and locking the keyboard support in a predetermined location with a locking cam.

6. The method of claim 5 further comprising the step of positioning a reference material plate mounted to the workstation in a desired position.

7. The method of claim 5 further comprising the step of pivoting a mouse plate pivotally mounted to the keyboard plate to a position for operator use of a mouse supported on the mouse plate.

8. A workstation for a computer having a monitor and a keyboard, comprising:

a base;

a pedestal mounted on said base for a vertical movement relative the base;

a monitor support secured to the pedestal and mounting the monitor for horizontal pivotal motion;

a keyboard support secured to the pedestal and mounting the keyboard for horizontal pivotal motion independent of the monitor; and the keyboard support providing for a horizontal pivotal motion below and behind the keyboard mounted on the keyboard support.

9. A workstation for a computer having a monitor and a keyboard, comprising:

a base;

a pedestal mounted on said base for a vertical movement relative the base;

a monitor support secured to the pedestal and mounting the monitor for horizontal pivotal motion;

a keyboard support secured to the pedestal and mounting the keyboard for horizontal pivotal motion independent of the monitor; and the pedestal permiting pivotal motion of the monitor support and keyboard support about a vertical axis relative to the base.

10. The workstation of claim 9 wherein the range of vertical pivotal motion of the pedestal is about 90°.

11. A workstation for a computer having a monitor and a keyboard, comprising:

a base;

a pedestal mounted on said base for a vertical movement relative the base;

a monitor support secured to the pedestal and mounting the monitor for horizontal pivotal motion;

a keyboard support secured to the pedestal and mounting the keyboard for horizontal pivotal motion independent of the monitor; and the monitor support being formed by a monitor yoke and a yoke receiver, the monitor yoke mounted on the yoke receiver for pivotal motion about a horizontal axis.

12. A workstation for a computer having a monitor, keyboard, computer tower and mouse, comprising:

a base mounted on swivel casters;

a pedestal mounted on said base permitting a portion of said pedestal to move vertically relative the base;

a platform assembly mounted on said portion of said pedestal;

a monitor support secured to the platform assembly, said monitor support having a monitor yoke and a yoke receiver, the mointor yoke receiving said monitor, said monitor yoke and yoke receiver pivotally secured together to permit horizontal pivotal motion of said monitor yoke and said monitor relative the workstation;

a keyboard support mounted to said platform assembly for vertical motion relative thereto, a locking mechanism locking the keyboard support in a predetermined relation relative to the platform assembly; and a keyboard plate mounted to said keyboard support for horizontal pivotal motion by support angles, the keyboard being supported on said keyboard plate.

13. The workstation of claim 12 further having a reference material plate mounted on the workstation.

* * * * *